US010151456B2

(12) United States Patent
Ma

(10) Patent No.: US 10,151,456 B2
(45) Date of Patent: Dec. 11, 2018

(54) LAMP HOLDER

(71) Applicant: Xiaoyuan Ma, Shenzhen (CN)

(72) Inventor: Xiaoyuan Ma, Shenzhen (CN)

( * ) Notice: Subject to any disclaimer, the term of this patent is extended or adjusted under 35 U.S.C. 154(b) by 169 days.

(21) Appl. No.: 15/417,235

(22) Filed: Jan. 27, 2017

(65) Prior Publication Data

US 2018/0195698 A1 Jul. 12, 2018

(30) Foreign Application Priority Data

Jan. 12, 2017 (CN) ..... 2017 2 0035621 U

(51) Int. Cl.
*H01R 13/58* (2006.01)
*F21V 17/16* (2006.01)

(52) U.S. Cl.
CPC ..... *F21V 17/16* (2013.01)

(58) Field of Classification Search
CPC ..... H01R 13/5833; H01R 13/5841; H01R 13/585
USPC ..... 439/456, 457, 458, 459
See application file for complete search history.

(56) References Cited

U.S. PATENT DOCUMENTS 2,223,469 A * 12/1940 Tulchin ..... H01R 33/22 439/459
3,858,160 A * 12/1974 Denton ..... D06F 75/28 174/135
6,010,356 A * 1/2000 Hale ..... H01R 4/2433 439/419
7,204,633 B2 * 4/2007 Yun ..... H01R 33/06 362/260
2015/0345753 A1 * 12/2015 Mochizuki ..... F21V 5/04 362/375

* cited by examiner

*Primary Examiner* — Phuong Dinh
(74) *Attorney, Agent, or Firm* — Wayne & King LLC

(57) ABSTRACT

The utility model discloses a novel lamp holder which comprises a lamp holder for installing a lamp and a base; the lamp holder is fixed to the base, wherein a wire-fixing device is integrally formed at the bottom of the base; the wire-fixing device is composed of a wing-shaped support and a wire-clamping plate; the wing-shaped support is a winding support which is formed by suspended extension towards the left side and the right side of the base from the edge of one side of the bottom of the base; the two sides of the front end of the wire-clamping plate are provided with wire-clamping grooves respectively; and the middle part of the wire-clamping plate is provided with a wire-clamping hole. The novel lamp holder is simple in structure, reduces product parts, lowers production cost and is convenient to dismantle and operate, and a process is simplified.

2 Claims, 2 Drawing Sheets

LAMP HOLDER

CROSS-REFERENCE TO RELATED APPLICATIONS

This application claims priority benefits to Chinese Patent Application No. 2017200356212 filed Jan. 12, 2017. The content of the aforementioned application, including any intervening amendments thereto, s incorporated herein by reference.

TECHNICAL FIELD

The utility model relates to the technical field of lamp holders of lamps, and in particular to an integrated lamp holder capable of fixing a wire.

BACKGROUND

A lamp is inevitably pulled in the daily using process, and a wire drops very easily under the effect of external force. At present, the wire is usually fixed through the matching of plastics or a metal pressing piece and a screw in the industry. However, this fixing structure is relatively complex in manufacturing and installation process, and the cost is increased.

SUMMARY

The objective of the utility model is to provide an integrated lamp holder which is simple in structure, reduces product parts, lowers production cost, is convenient to dismantle and operate and can fix a wire, so as to solve the problems mentioned in the background art.

In order to achieve the aforementioned objective, the utility model provides the following technical solution:

a novel lamp holder comprising a lamp holder for installing a lamp and a base, wherein the lamp holder is fixed to the base, a wire-fixing device is integrally formed at the bottom of the base; the wire-fixing device is composed of a wing-shaped support and a wire-clamping plate; the wing-shaped support is a winding support which is formed by suspended extension towards the left side and the right side of the base from the edge of one side of the bottom of the base; the two sides of the front end of the wire-clamping plate are provided with wire-clamping grooves respectively; and the middle part of the wire-clamping plate is provided with a wire-clamping hole.

As a preferred solution, the wing-shaped support end the wire-clamping plate are integrally formed at the bottom of the base.

Compared with the prior art, the utility model has the following beneficial effects:

(1) the novel lamp holder is simple in structure, reduces product parts and lowers production cost;

(2) a process is simplified, and the novel lamp holder is convenient to dismantle and operate.

Figure 1:
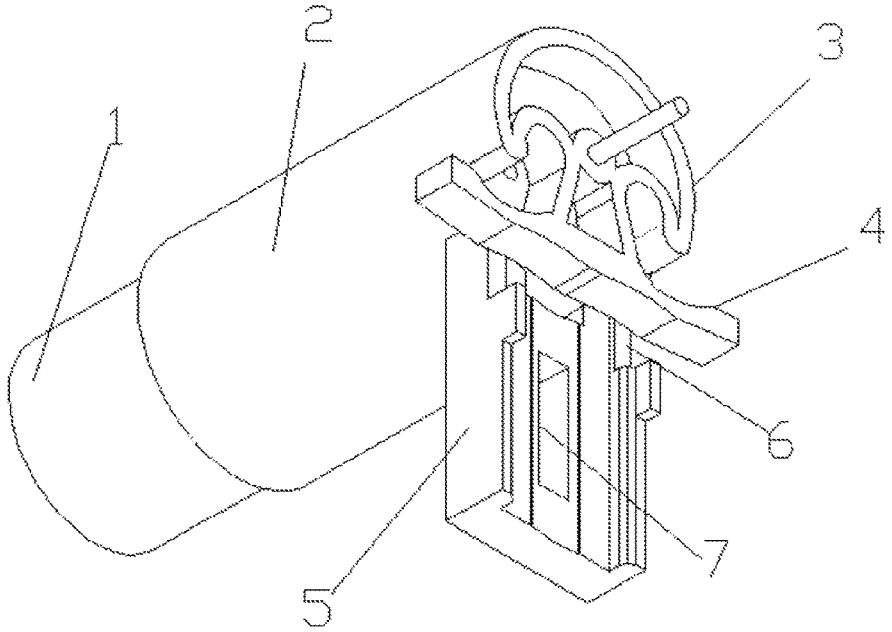
FIG. 1 is a structural diagram view of the utility model.

In the figure, there is a lamp holder 1, a base 2, a wire-fixing device 3, a support 4, a wire-clamping plate 5, wire-clamping grooves 6 and a wire-clamping hole 7.

DESCRIPTION OF EMBODIMENTS

The technical solutions in embodiments of the utility model will be described clearly and completely below by combination with accompanying drawings of the utility model. Obviously, the described embodiments are only part of embodiments of the utility model rather than all embodiments. Based on the embodiments of the utility model, all other embodiments obtained by those skilled in the art without creative labor shall belong to the protective scope of the utility model.

Referring to FIG. 1, a novel lamp holder according to the utility model comprises a lamp holder 1 for installing a lamp and a base 2; and the lamp holder 1 is fixed to the base 2. The lamp holder 1 is used for assembling and connecting the lamp. A wire-fixing device 3 is integrally formed at the bottom of the base 2; the ware-fixing device 3 is composed of a wing-shaped support 4 and a wire-clamping plate 5; the wing-shaped support 4 is a winding support which is formed by suspended extension towards the left side and the right side of the base 2 from the edge of one side of the bottom of the base 2; the two sides of the front end of the wire-clamping plate 5 are provided with wire-clamping grooves 6 respectively: and the middle part of the wire-clamping plate 5 is provided with a wire-clamping hole 7. The wing-shaped support 4 and the wire-clamping plate 5 are integrally formed at the bottom of the base 2.

Figure 2:
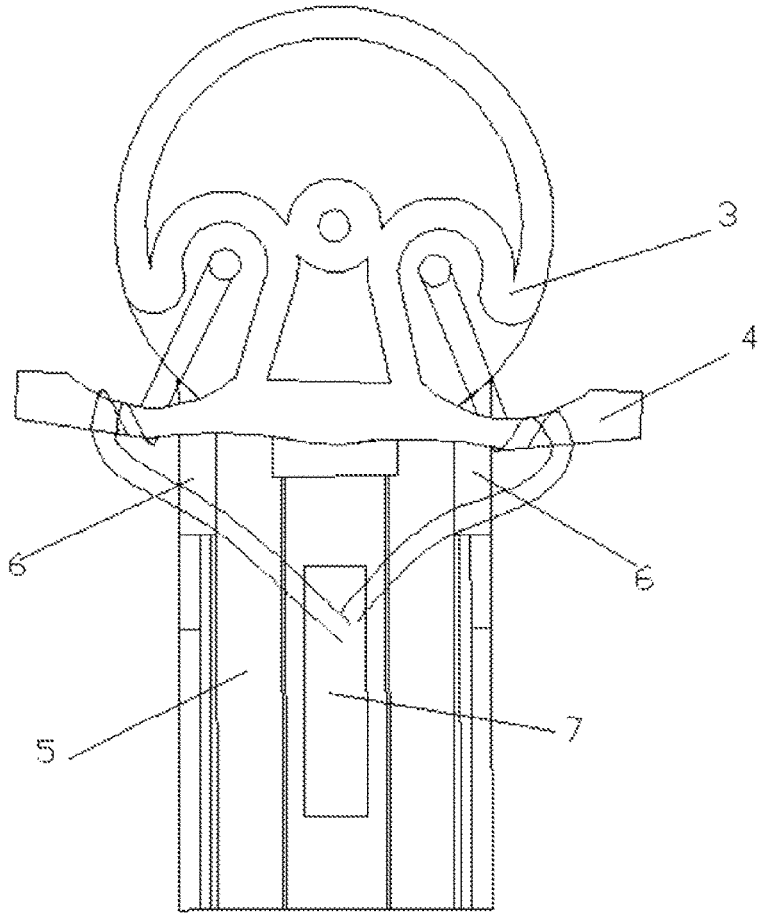
FIG. 2 is a structural diagram view of a wire-fixing device at the bottom of a base according to the utility model.

Referring to FIG. 2, as shown in this figure, two wires connected with an electrode slice of the lamp well are wound around the support 4 respectively, pass through wire-clamping grooves 6 formed in the two sides of the front end of the wire-clamping plate 5, finally penetrate into a wire-clamping hole 7 formed in the middle part of the wire-clamping plate 5, and then extend to a lamp housing for use. When the novel lamp holder is used and is subjected to external tensile force, the whole wire-clamping plate and the support bear the tensile force, so that pressure on the joint of the wires and the electrode slice is alleviated, and the wires and the electrode slice are prevented from dropping and be disconnected.

Though the embodiments of the utility model have been illustrated and described, those skilled in the art can perform various variations, modifications and replacements on these embodiments without departing from the principle and the spirit of the utility model, and the range of the utility model is defined by the appended claims and equivalents thereof.

I claim:

1. A novel lamp holder, comprising a lamp holder for installing a lamp and a base; the lamp, holder is fixed to the base, wherein a wire-fixing device is integrally formed at the bottom of the base; the wire-fixing device is composed of a wing-shaped support and a wire-clamping plate; the wing-shaped support is a winding support which is formed by suspended extension towards the left side and the right side of the base from the edge of one side of the bottom of the base; the two sides of the front end of the wire-clamping plate, are provided with wire-clamping grooves respectively; and the middle part of the wire-clamping plate is provided with a wire-clamping hole.

2. The novel lamp holder according to claim 1, wherein the wing-shaped support and the wire-clamping plate are integrally formed at the bottom of the base.

* * * * *